US008278230B2

(12) United States Patent
Smets et al.

(10) Patent No.: US 8,278,230 B2
(45) Date of Patent: Oct. 2, 2012

(54) PERFUME SYSTEMS

(75) Inventors: Johan Smets, Lubbeek (BE); David Thomas Stanton, Hamilton, OH (US); Rafael Trujillo Rosaldo, Mason, OH (US); Allan Campbell McRitchie, Tyne and Wear (GB); Hugo Robert Germain Denutte, Hofstade (BE); Thierry Granier, Duebendorf (CH); Andreas Hanhart, Uster (CH); Jerzy A. Bajgrowicz, Zurich (CH); Philip Kraft, Dubendorf (CH)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/971,070

(22) Filed: Dec. 17, 2010

(65) Prior Publication Data

US 2011/0086793 A1 Apr. 14, 2011

Related U.S. Application Data

(63) Continuation of application No. 12/133,866, filed on Jun. 5, 2008, now abandoned.

(60) Provisional application No. 60/933,172, filed on Jun. 5, 2007.

(51) Int. Cl.
*C11D 3/50* (2006.01)

(52) U.S. Cl. ..... 501/101; 512/2

(58) Field of Classification Search ..... 510/101; 512/2

See application file for complete search history.

(56) References Cited

U.S. PATENT DOCUMENTS

| | | | | |
|---|---|---|---|---|
| 4,052,341 | A | 10/1977 | Naipawer et al. | |
| 4,278,569 | A | 7/1981 | Yoshida et al. | |
| 4,324,704 | A | 4/1982 | Trenkle et al. | |
| 4,430,243 | A | 2/1984 | Bragg | |
| 4,515,705 | A | 5/1985 | Moeddel | |
| 4,537,706 | A | 8/1985 | Severson, Jr. | |
| 4,537,707 | A | 8/1985 | Severson, Jr. | |
| 4,550,862 | A | 11/1985 | Barker et al. | |
| 4,561,998 | A | 12/1985 | Wertz et al. | |
| 4,597,898 | A | 7/1986 | Vander Meer | |
| 4,968,451 | A | 11/1990 | Scheibel | |
| 5,486,303 | A | 1/1996 | Capeci et al. | |
| 5,489,392 | A | 2/1996 | Capeci et al. | |
| 5,516,448 | A | 5/1996 | Capeci et al. | |
| 5,565,145 | A | 10/1996 | Watson et al. | |
| 5,565,422 | A | 10/1996 | Del Greco et al. | |
| 5,569,645 | A | 10/1996 | Dinniwell et al. | |
| 5,574,005 | A | 11/1996 | Welch et al. | |
| 5,576,282 | A | 11/1996 | Miracle et al. | |
| 5,595,967 | A | 1/1997 | Miracle et al. | |
| 5,597,936 | A | 1/1997 | Perkins et al. | |
| 5,626,852 | A * | 5/1997 | Suffis et al. | 424/401 |
| 5,691,297 | A | 11/1997 | Nassano et al. | |
| 5,879,584 | A | 3/1999 | Bianchetti et al. | |
| 5,929,022 | A | 7/1999 | Velazquez | |
| 6,103,678 | A | 8/2000 | Masschelein et al. | |
| 6,225,464 | B1 | 5/2001 | Hiler, II et al. | |
| 6,294,514 | B1 | 9/2001 | Welling | |
| 6,306,812 | B1 | 10/2001 | Perkins et al. | |
| 6,326,348 | B1 | 12/2001 | Vinson et al. | |
| 6,376,445 | B1 | 4/2002 | Bettiol et al. | |
| 6,413,920 | B1 | 7/2002 | Bettiol et al. | |
| 6,451,751 | B1 * | 9/2002 | Busch et al. | 510/349 |
| 6,511,948 | B1 | 1/2003 | Bettiol et al. | |
| 6,566,312 | B2 | 5/2003 | Bettiol et al. | |
| 6,699,823 | B2 | 3/2004 | Bettiol et al. | |
| 6,723,313 | B2 | 4/2004 | Kraft | |
| 6,740,713 | B1 | 5/2004 | Busch et al. | |
| 6,764,986 | B1 | 7/2004 | Busch et al. | |
| 6,790,815 | B1 | 9/2004 | Bettiol et al. | |
| 6,858,575 | B2 | 2/2005 | Smets et al. | |
| 6,906,012 | B1 | 6/2005 | Saini et al. | |
| 6,916,769 | B2 | 7/2005 | McRitchie et al. | |
| 6,972,276 | B1 | 12/2005 | Besselievre et al. | |
| 7,012,047 | B2 | 3/2006 | Bettiol et al. | |
| 7,078,570 | B2 | 7/2006 | Goeke | |
| 2003/0134772 | A1 | 7/2003 | Smets et al. | |
| 2003/0158079 | A1 | 8/2003 | Dykstra et al. | |
| 2003/0199422 | A1 | 10/2003 | Birkbeck et al. | |
| 2003/0211963 | A1 | 11/2003 | Bettiol et al. | |
| 2003/0228992 | A1 | 12/2003 | Smets et al. | |
| 2004/0018955 | A1 | 1/2004 | Wevers et al. | |
| 2004/0097397 | A1 | 5/2004 | Mohr et al. | |
| 2004/0116320 | A1 | 6/2004 | Bettiol et al. | |
| 2004/0176643 | A1 * | 9/2004 | Sato et al. | 568/28 |
| 2004/0220074 | A1 | 11/2004 | Fehr et al. | |
| 2005/0009727 | A1 | 1/2005 | Bettiol et al. | |
| 2005/0043205 | A1 | 2/2005 | Bettiol et al. | |
| 2005/0043208 | A1 | 2/2005 | Bettiol et al. | |
| 2005/0123497 | A1 | 6/2005 | Dykstra et al. | |
| 2005/0239667 | A1 | 10/2005 | Bettiol et al. | |
| 2006/0014655 | A1 | 1/2006 | Smets et al. | |
| 2006/0172903 | A1 | 8/2006 | Bettiol et al. | |
| 2006/0287219 | A1 | 12/2006 | Dykstra et al. | |
| 2007/0099818 | A1 | 5/2007 | Bettiol et al. | |
| 2007/0232507 | A1 | 10/2007 | Bettiol et al. | |
| 2008/0032910 | A1 | 2/2008 | Smets et al. | |
| 2008/0200359 | A1 | 8/2008 | Smets et al. | |
| 2008/0227676 | A1 | 9/2008 | Bettiol et al. | |
| 2008/0305977 | A1 | 12/2008 | Smets et al. | |
| 2009/0048351 | A1 | 2/2009 | Smets et al. | |

FOREIGN PATENT DOCUMENTS

| | | | |
|---|---|---|---|
| EP | 0 231 556 | A1 | 8/1987 |
| WO | WO 00/00580 | A1 | 1/2000 |
| WO | WO 00/02982 | A2 | 1/2000 |
| WO | WO 00/32601 | A2 | 6/2000 |

* cited by examiner

OTHER PUBLICATIONS

International Search Report, mailed Sep. 17, 2008, 6 pgs., International Application No. PCT/US2008/065899.

*Primary Examiner* — John Hardee

(74) *Attorney, Agent, or Firm* — James F. McBride; Andrew J. Mueller

(57) ABSTRACT

The present application relates to perfume systems and consumer products comprising new perfumes and/or such perfume systems, as well as processes for making and using such perfume systems and consumer products.

1 Claim, No Drawings

PERFUME SYSTEMS

CROSS-REFERENCES TO RELATED APPLICATIONS

This application is a continuation of and claims priority under 35 U.S.C. §120 to U.S. application Ser. No. 12/133,866, filed Jun. 5, 2008 now abandoned which in turn claims priority under 35 U.S.C. §119(e) to U.S. Provisional Application Ser. No. 60/933,172, filed Jun. 5, 2007.

FIELD OF INVENTION

The present application relates to perfume systems and consumer products comprising perfumes and/or such perfume systems, as well as processes for making and using such perfume systems and consumer products.

BACKGROUND OF THE INVENTION

Consumer products may comprise one or more perfumes and/or perfume systems that can provide a desired scent to such product and/or a situs that is contacted with such a product and/or mask an undesirable odor. While current perfumes and perfume systems provide desirable odors, consumers continue to seek products that have scents that may be long lasting and that are tailored to their individual desires—unfortunately the pool of perfumes and perfume systems that is available is still too limited to meet such desires. Thus, perfumers need an ever larger pool of perfumes and perfume systems.

Applicants believe that the compositions disclosed herein meet such need as such compositions include perfume reaction products, and perfumed compositions comprising new perfumes and perfume systems including perfume reaction products.

SUMMARY OF THE INVENTION

The present application relates to perfume systems and consumer products comprising new perfumes and/or such perfume systems, as well as processes for making and using such perfume systems and consumer products.

DETAILED DESCRIPTION OF THE INVENTION

Definitions

As used herein "consumer product" means baby care, beauty care, fabric & home care, family care, feminine care, health care, snack and/or beverage products or devices intended to be used or consumed in the form in which it is sold, and not intended for subsequent commercial manufacture or modification. Such products include but are not limited to diapers, bibs, wipes; products for and/or methods relating to treating hair (human, dog, and/or cat), including, bleaching, coloring, dyeing, conditioning, shampooing, styling; deodorants and antiperspirants; personal cleansing; cosmetics; skin care including application of creams, lotions, and other topically applied products for consumer use; and shaving products, products for and/or methods relating to treating fabrics, hard surfaces and any other surfaces in the area of fabric and home care, including: air care, car care, dishwashing, fabric conditioning (including softening), laundry detergency, laundry and rinse additive and/or care, hard surface cleaning and/or treatment, and other cleaning for consumer or institutional use; products and/or methods relating to bath tissue, facial tissue, paper handkerchiefs, and/or paper towels; tampons, feminine napkins; products and/or methods relating to oral care including toothpastes, tooth gels, tooth rinses, denture adhesives, tooth whitening; over-the-counter health care including cough and cold remedies, pain relievers, RX pharmaceuticals, pet health and nutrition, and water purification; processed food products intended primarily for consumption between customary meals or as a meal accompaniment (non-limiting examples include potato chips, tortilla chips, popcorn, pretzels, corn chips, cereal bars, vegetable chips or crisps, snack mixes, party mixes, multigrain chips, snack crackers, cheese snacks, pork rinds, corn snacks, pellet snacks, extruded snacks and bagel chips); and coffee.

As used herein, the term "cleaning and/or treatment composition" includes, unless otherwise indicated, granular or powder-form all-purpose or "heavy-duty" washing agents, especially cleaning detergents; liquid, gel or paste-form all-purpose washing agents, especially the so-called heavy-duty liquid types; liquid fine-fabric detergents; hand dishwashing agents or light duty dishwashing agents, especially those of the high-foaming type; machine dishwashing agents, including the various tablet, granular, liquid and rinse-aid types for household and institutional use; liquid cleaning and disinfecting agents, including antibacterial hand-wash types, cleaning bars, mouthwashes, denture cleaners, dentifrice, car or carpet shampoos, bathroom cleaners; hair shampoos and hair-rinses; shower gels and foam baths and metal cleaners; as well as cleaning auxiliaries such as bleach additives and "stain-stick" or pre-treat types, substrate-laden products such as dryer added sheets, dry and wetted wipes and pads, nonwoven substrates, and sponges; as well as sprays and mists.

As used herein, the term "fabric care composition" includes, unless otherwise indicated, fabric softening compositions, fabric enhancing compositions, fabric freshening compositions and combinations there of.

As used herein, the articles such as "a" and "an" when used in a claim, are understood to mean one or more of what is claimed or described.

As used herein, the terms "include", "includes" and "including" are meant to be non-limiting.

As used herein, the term "solid" includes granular, powder, bar and tablet product forms.

As used herein, the term "fluid" includes liquid, gel, paste and gas product forms.

As used herein, the term "situs" includes paper products, fabrics, garments, hard surfaces, hair and skin.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Suitable Perfumes

Suitable perfumes include perfumes having of Formulas I through VI below.

I

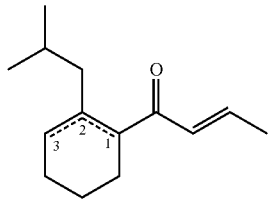

wherein the bond between C-1 and C-2 is a single bond and the dotted line together with the bond between C-2 and C-3 represents a double bond; or the bond between C-2 and C-3 is a single bond and the dotted line together with the bond between C-1 and C-2 represents a double bond. Such molecule being 1-(2-isobutylcyclohex-1-enyl)but-2-en-1-one and 1-(2-isobutylcyclohex-2-enyl)but-2-en-1-one.

II

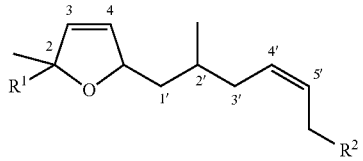

wherein $R^1$ is hydrogen or methyl;

$R^2$ is $C_1$-$C_3$ alkyl; and the double bond between C-4' and C-5' is either in (E)- or (Z)-configuration.

An example of a molecule having Formula II is (4'Z)-2,2-dimethyl-5-(2'-methyloct-4'-enyl)-2,5-dihydrofuran.

III

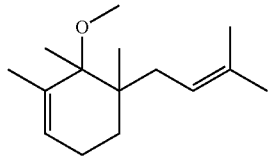

The molecule having Formula III being known as 6-methoxy-1,5,6-trimethyl-5-(3-methylbut-2-enyl)cyclohex-1-ene.

IV

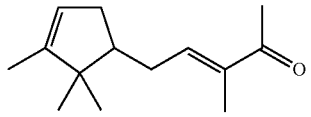

The molecule having Formula IV being known as (E)-3-methyl-5-(2,2,3-trimethylcyclopent-3-enyl)pent-3-en-2-one.

V

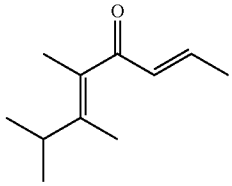

The molecule having Formula V being known as (2E,5E/Z)-5,6,7-trimethylocta-2,5-dien-4-one.

VI

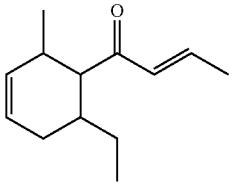

The molecule having Formula VI being known as (E)-1-(6-ethyl-2-methylcyclohex-3-enyl)but-2-en-1-one.

Molecules having Formulae I may be prepared by acylation of 1-isobutyl-cyclohexene with crotonyl chloride or crotonic anhydride in the presence of a Lewis acid leading to the monoconjugated butanone, i.e. a compound of formula (I) wherein the bond between C-1 and C-2 is a single bond and the dotted line together with the bond between C-2 and C-3 represents a double bond, that could be isomerized to the diconjugated butanone, i.e. a compound of Formula (I) wherein the bond between C-2 and C-3 is a single bond and the dotted line together with the bond between C-1 and C-2 represents a double bond, by heating in toluene in the presence of an acid e.g. PTSA. Examples 1 through 3 of the present application further illustrate such teachings Molecules having Formula (II) may be prepared by the Wittig reaction of 3-methyl-5-oxopentyl acetate with $C_3$-$C_5$ alkyl triphenylphosphonium halides, and subsequent saponification resulting in 3-methyl substituted alk-5-enals. By reaction of these 3-methylalk-5-enals with Grignard reagents of but-3-yn-2-ol and 2-methylbut-3-yn-2-ol, respectively, double-unsaturated 1,4-diols are accessible, which can be cyclized to 2-methyl-substituted 5-(2'-methylalk-4'-enyl)-2,5-dihydrofurans by means of common dehydration reagents, such as potassium hydrogen sulphate. By modification of the condition of the Wittig reaction, the stereochemistry of the $\Delta^4$-double bond in the side chain can also be controlled. This as well as the synthesis or resolution of specific enantiomers or diastereoisomers is general state of the art; the general formula comprises not only all double-bond isomers, but also all possible enantiomeric and diastereomeric compositions. Due to simple cost constraints, the preparation of diastereoisomeric mixtures with cis-configured double bonds is, however, generally advantageous. Example 4 further illustrates such teachings.

Molecules having Formula (VI) can be made by Diels-Alder cycloaddition followed by aldol condensation with acetaldehyde and water elimination under conditions known in the art.

Molecules having Formulae III through V can also be made in accordance with the teachings of U.S. Pat. Nos. 4,052,341; 6,723,313 B2 and 7,078,570 B2.

Perfume Reaction Products

In one aspect, the perfume reaction product described and claimed herein comprises the reaction product of one or more perfumes selected from perfumes of Formulae I, and IV through VI below and a material that comprises one or more heteroatoms, for example nitrogen, sulfur, phosphorus and/or selenium. In yet another aspect, said perfume reaction product comprises the reaction product of one or more perfumes selected from perfumes of Formulae I, and IV through VI below and a material that contains one or more amine moieties, thiol moieties, phosphine moieties and/or selenol moieties. In yet another aspect, said perfume reaction product comprises the reaction product of one or more perfumes selected from perfumes of Formulae I, and IV through VI below and a material that contains one or more primary amine moieties, secondary amine moieties and/or thiol moieties.

In one aspect, the perfume reaction product described and claimed herein comprises the reaction product of a perfume having Formulae I below and a material that contains one or more heteroatoms, for example nitrogen, sulfur, phosphorus and/or selenium. In yet another aspect, said perfume reaction product comprises the reaction product of a perfume having Formulae I below and a material that contains one or more amine moieties, thiol moieties, phosphine moieties and/or selenol moieties. In yet another aspect, said perfume reaction product comprises the reaction product of a perfume having Formulae I below and a material that contains one or more primary amine moieties, secondary amine moieties and/or a thiol moieties.

In all cases, the perfume reaction product is produced before it is combined with other materials to form a consumer product, for example, a cleaning and/or fabric treatment product.

In all cases, the material that is reacted with the perfume, for example, the material that contains one or more heteroatoms, may have Odor Intensity Index of less than that of a 1% solution of methylanthranilate in dipropylene glycol as determined by Test Method 1 which is provided in the Test Methods section of the present application.

In all cases, the perfume reaction product may have a Dry Surface Odor Index of greater than 5 or even greater than 10 as determined by Test Method 2 which is provided in the Test Methods section of the present application.

Suitable perfume reaction products may be made in accordance with the teachings of US Patent Applications 2003/0199422 A1; 2004/0220074 A1 and U.S. Pat. Nos. 6,451,751 B1 and 6,413,920 B1 and Example 6 of the present specification. Suitable materials that contain a heteroatom and which can be used to form reaction products are detailed in US Patent Applications 2003/0199422 A1; 2004/0220074 A1 and U.S. Pat. Nos. 6,451,751 B1 and 6,413,920 B1 and Example 6 of the present specification. Such materials may be, but need not be, polymeric. Suitable versions of such materials may be obtained from BASF AG of Ludwigshafen, Germany under, for example, the tradename Lupasol®. Suitable polyethyleneimines commercially available under the tradename Lupasol® include Lupasol® FG (MW 800), G20wfv (MW 1300), PR8515 (MW 2000), WF (MW 25000), FC (MW 800), G20 (MW 1300), G35 (MW 1200), G100 (MW 2000), HF (MW 25000), P (MW 750000), PS (MW 750000), SK (MW 2000000), SNA (MW 1000000).

Compositions

In one aspect, compositions comprising one or more perfumes selected from perfumes having Formulae I through VI; Formulae I, II and/or VI, or Formulae I and/or II, all as previously disclosed in the present specification, and an adjunct ingredient is disclosed.

In one aspect, compositions comprising an embodiment of the perfume reaction product, as disclosed in the present specification, and an adjunct ingredient is disclosed.

In one aspect, such perfume reaction product comprises the reaction product of one or more perfumes selected from perfumes of Formulae I, and IV through VI; or Formulae I, all as disclosed in the present specification, and a material that contains one or more heteroatoms, for example nitrogen, sulfur, phosphorus and/or selenium. In yet another aspect, said perfume reaction product comprises the reaction product of one or more perfumes selected from perfumes of Formulae I, and IV through VI; or Formula I, all as disclosed in the present specification, and a material that contains one or more amine moieties, thiol moieties, phosphine moieties and/or selenol moieties. In yet another aspect, said perfume reaction product comprises the reaction product of one or more perfumes selected from perfumes of Formulae I, and IV through VI; or Formula I, all as disclosed in the present specification, and a material that contains one or more primary amine moieties, secondary amine moieties and/or thiol moieties.

In one aspect, compositions comprising a perfume selected from one or more perfumes of Formulae I through VI; Formulae I, II and/or VI; or Formulae I, and/or II, as disclosed in the present specification, and a material that contains one or more heteroatoms, for example nitrogen, sulfur, phosphorus and/or selenium are disclosed. In yet another aspect, compositions comprising one or more perfumes selected from perfumes of Formulae I through VI; Formulae I, II and/or VI; or Formulae I, and/or II as disclosed in the present specification, and a material that contains one or more amine moieties, thiol moieties, phosphine moieties and/or selenol moieties are disclosed. In yet another aspect, compositions comprising one or more perfumes selected from perfumes of Formulae I through VI; Formulae I, II and/or VI; or Formulae I, and/or II, as disclosed in the present specification, and a material that contains one or more primary amine moieties, secondary amine moieties and/or thiol moieties are disclosed. The aforementioned suitable perfumes and materials may be added to the composition at separate times or simultaneously but are not pre-reacted to form a perfume reaction product prior to being added to said compositions. In all cases, such material, for example, the material that contains one or more a heteroatoms, may have an Odor Intensity Index of less than that of a 1% solution of methylanthranilate in dipropylene glycol as determined by Test Method 1 which is provided in the Test Methods section of the present application.

In any of the aforementioned aspects, such compositions may be fluids or solids.

In any of the aforementioned aspects, such compositions may be consumer products.

In any of the aforementioned aspects, such compositions may be cleaning and/or fabric treatment products.

Furthermore, while the precise level of perfume and/or perfume reaction product that is employed depends on the type and end use of the product comprising such composition, any of the aforementioned aspects, may comprise, based on total product weight, from about 0.001% to about 25%, from about 0.01% to about 5%, or even from about 0.05% to about 3% perfume and/or perfume system.

Aspects of the invention include the use of the perfume and/or perfume systems of the present invention in laundry detergent compositions (e.g., TIDE™), hard surface cleaners (e.g., MR CLEAN™), automatic dishwashing liquids (e.g., CASCADE™), dishwashing liquids (e.g., DAWN™), and floor cleaners (e.g., SWIFFER™). Non-limiting examples of cleaning compositions may include those described in U.S. Pat. Nos. 4,515,705; 4,537,706; 4,537,707; 4,550,862; 4,561, 998; 4,597,898; 4,968,451; 5,565,145; 5,929,022; 6,294,514; and 6,376,445. The cleaning compositions disclosed herein are typically formulated such that, during use in aqueous cleaning operations, the wash water will have a pH of between about 5 and about 12, or between about 7.5 and 10.5. Liquid dishwashing product formulations typically have a pH between about 6.8 and about 9.0. Cleaning products are typically formulated to have a pH of from about 7 to about 12. Techniques for controlling pH at recommended usage levels include the use of buffers, alkalis, acids, etc., and are well known to those skilled in the art.

Fabric treatment compositions disclosed herein typically comprise a fabric softening active ("FSA"). Suitable fabric softening actives, include, but are not limited to, materials selected from the group consisting of quats, amines, fatty esters, sucrose esters, silicones, dispersible polyolefins, clays, polysaccharides, fatty oils, polymer latexes and mixtures thereof.

Adjunct Materials

For the purposes of the present invention, the non-limiting list of adjuncts illustrated hereinafter are suitable for use in the instant compositions and may be desirably incorporated in certain embodiments of the invention, for example to assist or enhance performance, for treatment of the substrate to be cleaned, or to modify the aesthetics of the composition as is the case with perfumes, colorants, dyes or the like. It is understood that such adjuncts are in addition to the components that are supplied via Applicants' perfumes and/or perfume systems. The precise nature of these additional components, and levels of incorporation thereof, will depend on the physical form of the composition and the nature of the operation for which it is to be used. Suitable adjunct materials include, but are not limited to, surfactants, builders, chelating agents, dye transfer inhibiting agents, dispersants, enzymes, and enzyme stabilizers, catalytic materials, bleach activators, polymeric dispersing agents, clay soil removal/anti-redeposition agents, brighteners, suds suppressors, dyes, additional perfume and perfume delivery systems, structure elasticizing agents, fabric softeners, carriers, hydrotropes, processing aids and/or pigments. In addition to the disclosure below, suitable examples of such other adjuncts and levels of use are found in U.S. Pat. Nos. 5,576,282, 6,306,812 B1 and 6,326,348 B1 that are incorporated by reference.

Each adjunct ingredients is not essential to Applicants' compositions. Thus, certain embodiments of Applicants' compositions do not contain one or more of the following adjuncts materials: bleach activators, surfactants, builders, chelating agents, dye transfer inhibiting agents, dispersants, enzymes, and enzyme stabilizers, catalytic metal complexes, polymeric dispersing agents, clay and soil removal/anti-redeposition agents, brighteners, suds suppressors, dyes, additional perfumes and perfume delivery systems, structure elasticizing agents, fabric softeners, carriers, hydrotropes, processing aids and/or pigments. However, when one or more adjuncts are present, such one or more adjuncts may be present as detailed below:

Surfactants—The compositions according to the present invention can comprise a surfactant or surfactant system wherein the surfactant can be selected from nonionic and/or anionic and/or cationic surfactants and/or ampholytic and/or zwitterionic and/or semi-polar nonionic surfactants. The surfactant is typically present at a level of from about 0.1%, from about 1%, or even from about 5% by weight of the cleaning compositions to about 99.9%, to about 80%, to about 35%, or even to about 30% by weight of the cleaning compositions.

Builders—The compositions of the present invention can comprise one or more detergent builders or builder systems. When present, the compositions will typically comprise at least about 1% builder, or from about 5% or 10% to about 80%, 50%, or even 30% by weight, of said builder. Builders include, but are not limited to, the alkali metal, ammonium and alkanolammonium salts of polyphosphates, alkali metal silicates, alkaline earth and alkali metal carbonates, aluminosilicate builders polycarboxylate compounds. ether hydroxypolycarboxylates, copolymers of maleic anhydride with ethylene or vinyl methyl ether, 1,3,5-trihydroxybenzene-2,4,6-trisulphonic acid, and carboxymethyl-oxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Chelating Agents—The compositions herein may also optionally contain one or more copper, iron and/or manganese chelating agents. If utilized, chelating agents will generally comprise from about 0.1% by weight of the compositions herein to about 15%, or even from about 3.0% to about 15% by weight of the compositions herein.

Dye Transfer Inhibiting Agents—The compositions of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in the compositions herein, the dye transfer inhibiting agents are present at levels from about 0.0001%, from about 0.01%, from about 0.05% by weight of the cleaning compositions to about 10%, about 2%, or even about 1% by weight of the cleaning compositions.

Dispersants—The compositions of the present invention can also contain dispersants. Suitable water-soluble organic materials are the homo- or co-polymeric acids or their salts, in which the polycarboxylic acid may comprise at least two carboxyl radicals separated from each other by not more than two carbon atoms.

Enzymes—The compositions can comprise one or more detergent enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination is a cocktail of conventional applicable enzymes like protease, lipase, cutinase and/or cellulase in conjunction with amylase.

Enzyme Stabilizers—Enzymes for use in compositions, for example, detergents can be stabilized by various techniques. The enzymes employed herein can be stabilized by the presence of water-soluble sources of calcium and/or magnesium ions in the finished compositions that provide such ions to the enzymes.

Catalytic Metal Complexes—Applicants' compositions may include catalytic metal complexes. One type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra (methyl-enephosphonic acid) and water-soluble salts thereof. Such catalysts are disclosed in U.S. Pat. No. 4,430,243.

If desired, the compositions herein can be catalyzed by means of a manganese compound. Such compounds and levels of use are well known in the art and include, for example, the manganese-based catalysts disclosed in U.S. Pat. No. 5,576,282.

Cobalt bleach catalysts useful herein are known, and are described, for example, in U.S. Pat. Nos. 5,597,936 and 5,595,967. Such cobalt catalysts are readily prepared by known procedures, such as taught for example in U.S. Pat. Nos. 5,597,936, and 5,595,967.

Compositions herein may also suitably include a transition metal complex of a macropolycyclic rigid ligand—abbreviated as "MRL". As a practical matter, and not by way of limitation, the compositions and cleaning processes herein can be adjusted to provide on the order of at least one part per hundred million of the benefit agent MRL species in the aqueous washing medium, and may provide from about 0.005 ppm to about 25 ppm, from about 0.05 ppm to about 10 ppm, or even from about 0.1 ppm to about 5 ppm, of the MRL in the wash liquor.

Suitable transition-metals in the instant transition-metal bleach catalyst include manganese, iron and chromium. Suitable MRL's herein are a special type of ultra-rigid ligand that is cross-bridged such as 5,12-diethyl-1,5,8,12-tetraazabicyclo[6.6.2]hexa-decane.

Suitable transition metal MRLs are readily prepared by known procedures, such as taught for example in WO 00/32601, and U.S. Pat. No. 6,225,464.

Processes of Making and Using Compositions

The compositions of the present invention can be formulated into any suitable form and prepared by any process chosen by the formulator, non-limiting examples of which are described in U.S. Pat. No. 5,879,584; U.S. Pat. No. 5,691,297; U.S. Pat. No. 5,574,005; U.S. Pat. No. 5,569,645; U.S. Pat. No. 5,565,422; U.S. Pat. No. 5,516,448; U.S. Pat. No. 5,489,392; and U.S. Pat. No. 5,486,303.

Method of Use

Compositions containing the benefit agent delivery particle disclosed herein can be used to clean or treat a situs inter alia a surface or fabric. Typically at least a portion of the situs is contacted with an embodiment of Applicants' composition, in neat form or diluted in a liquor, for example, a wash liquor and then the situs may be optionally washed and/or rinsed. In one aspect, a situs is optionally washed and/or rinsed, contacted with a particle according to the present invention or composition comprising said particle and then optionally washed and/or rinsed. For purposes of the present invention, washing includes but is not limited to, scrubbing, and mechanical agitation. The fabric may comprise most any fabric capable of being laundered or treated in normal consumer use conditions. Liquors that may comprise the disclosed compositions may have a pH of from about 3 to about 11.5. Such compositions are typically employed at concentrations of from about 500 ppm to about 15,000 ppm in solution. When the wash solvent is water, the water temperature typically ranges from about 5° C. to about 90° C. and, when the situs comprises a fabric, the water to fabric ratio is typically from about 1:1 to about 30:1.

Test Methods

Method 1: Odor Intensity Index Method

By Odor Intensity Index, it meant that the pure chemicals were diluted at 1% in Dipropylene Glycol, odor-free solvent used in perfumery. This percentage is more representative of usage levels. Smelling strips, or so called "blotters", were dipped and presented to the expert panelist for evaluation. Expert panelists are assessors trained for at least six months in odor grading and whose gradings are checked for accuracy and reproducibility versus a reference on an on-going basis. For each amine compound, the panelist was presented two blotters: one reference (Me Anthranilate, unknown from the panelist) and the sample. The panelist was asked to rank both smelling strips on the 0-5 odor intensity scale, 0 being no odor detected, 5 being very strong odor present.

Results:

The following represents the Odor Intensity Index of an amine compound suitable for use in the present invention and according to the above procedure. In each case, numbers are arithmetic averages among 5 expert panelists and the results are statistically significantly different at 95% confidence level:

| | |
|---|---|
| Methylanthranilate 1% (reference) | 3.4 |
| Ethyl-4-aminobenzoate (EAB) 1% | 0.9 |

Method 2: Measurement Method of Dry Surface Odor Index

Product Preparation:

The amine reaction product is added to the unperfumed product base.

The unperfumed product base, wherein the abbreviations are as defined herein after for the examples, is as follows:

| Component | % by weight |
|---|---|
| DEQA | 19.0 |
| HCl | 0.02 |
| PEG | 0.6 |
| Silicone antifoam | 0.01 |
| Electrolyte (ppm) | 1200 |
| Dye (ppm) | 50 |
| Water and minors to balance to 100% | |

Levels of amine reaction product are selected so as to obtain an odor grade on the dry fabric of at least 20. After careful mixing, by shaking the container in case of a liquid, with a spatula in case of a powder, the product is allowed to sit for 24 hrs.

Washing Process:

The resulting product is added into the washing machine in the dosage and in the dispenser appropriate for its category. The quantity corresponds to recommended dosages made for the corresponding market products: typically between 70 and 150 g for a detergent powder or liquid via current dosing device like granulette, or ariellette, and 25 and 40 ml for a liquid fabric softener. The load is composed of four bath towels (170 g) using a Miele W830 washing machine at 40° C. short cycle, water input: 15° Hardness at a temperature of 10-18° C., and full spin of 1200 rpm.

The same process is applied for the corresponding free perfume ingredient in consideration and is used as the reference. Dosages, fabric loads and washing cycles for the reference and the sample are identical.

Drying Process:

Within two hours after the end of the washing cycle, the spinned but still wet fabrics are assessed for their odors using the scale mentioned below. Afterwards, half of the fabric pieces are hung on a line for 24 hr drying, away from any possible contaminations. Unless specified, this drying takes place indoor. Ambient conditions are at temperature between 18-25 C. and air moisture between 50-80%. The other half is placed in a tumble drier and undergoes a full "very dry" cycle, i.e. in a Miele, Novotronic T430 set on program white-extra dry (full cycle). Tumble dry fabrics are also assessed on the next day. Fabrics are then stored in opened aluminum bags in an odor free room, and assessed again after 7 days.

Odor Evaluations:

Odor is assessed by expert panelists smelling carefully the fabrics. A 0-100 scale is used for all fabric odor gradings. The grading scale is as follows:

100=extremely strong perfume odor
75=very strong perfume odor
50=strong odor
40=moderate perfume odor
30=slight perfume odor
20=weak perfume odor
10=very weak perfume odor
0=no odor A difference of more than 5 grades after 1 day and/or 7 days between the amine reaction product and the perfume raw material is statistically significant. A difference of 10 grades or more after one day and/or 7 days represents a step-change. In other words, when a difference of grade of more than 5, preferably at least 10 is observed between the amine reaction product and the perfume raw material, after either 1 day or 7 day or both 1 day and 7 days, it can be concluded that the amine reaction product is suitable for use in the present invention, provided that the amine compound fulfill the Odor Intensity Index.

EXAMPLES

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

Example 1

(E)-1-(2-isobutylcyclohex-2-enyl)but-2-en-1-one a) 1-isobutylcyclohexanol

At −60° C., a solution of 1.7M tert-butyllithium in pentane (1000 ml, 1.7 mol, 2.1 eq.) in diethyl ether (800 ml) was treated dropwise within 1 h with isobutyl iodide (157 g, 0.81 mol, 1.0 eq.). The resulting solution was stirred at −70° C. for 45 min., warmed to 10° C., cooled to −70° C., and treated at this temperature within 4 h with cyclohexanone (100.7 ml, 0.971 mol, 1.2 eq.). At the end of the addition, the reaction mixture was allowed to reach room temperature before being poured into ice/$H_2O$ (500 ml) and acidified with concentrated HCl. The water phase was extracted with diethyl ether (300 ml) and the combined organic phases were washed with water (400 ml) and aqueous saturated NaCl solution (500 ml), dried (50 g $MgSO_4$) and the solvent evaporated to give the crude 1-isobutylcyclohexanol (148 g).

b) 1-isobutylcyclohex-1-ene

In a flask equipped with a Vigreux-distillation apparatus, crude 1-isobutylcyclohexanol (200 g, 1.28 mol) was treated with phosphoric acid (100 g) and heated at 145° C. under vacuum (170 mbar). While 1-isobutylcyclohex-1-ene and water distilled (boiling point 60° C.), a second fraction of 1-isobutylcyclohexanol (492 g, 3.15 mol) was added dropwise in the reaction flask. At the end of the addition, the thick reaction mixture was diluted with paraffin oil (100 ml) and additional phosphoric acid (50 g) and heated further (vacuum from 170 to 40 mbar). The distillate was decanted and the water phase extracted with pentane (100 ml). The combined org. phases were dried ($MgSO_4$) and the solvent evaporated to give 1-isobutylcyclohex-1-ene (448 g, 78%).

c) (E)-1-(2-isobutylcyclohex-2-enyl)but-2-en-1-one

At −70° C., a solution of tin tetrachloride (533 ml, 4.54 mol, 1.4 eq.) in dichloromethane (2.5 l) was treated with crotonyl chloride (350 ml, 90%, 3.24 mol, 1.0 eq.). The resulting solution was stirred for 30 min. and treated within 1.5 h with a solution of 1-isobutylcyclohex-1-ene (448 g, 3.24 mol) in dichloromethane (400 ml). The resulting mixture was stirred for 1 h at −70° C. and poured into ice/$H_2O$. The org. phase was first washed with concentrated NaOH then with $H_2O$, dried ($MgSO_4$), and the solvent evaporated. Short-path Vigreux-distillation (0.15 mbar, bath temperature: 160° C.) of the crude product (592 g) gave a fraction (495 g, boiling range: 90-130° C.) that was redistilled using again a short-path Vigreux-column (0.11 mbar, bath temperature: 160° C.) to give (E)-1-(2-isobutylcyclohex-2-enyl)but-2-en-1-one (202 g, 30%). Boiling point: 120° C. (0.11 mbar).

Example 2

(E)-1-(2-isobutylcyclohex-1-enyl)but-2-en-1-one/
(E)-1-(2-isobutylcyclohex-2-enyl)but-2-en-1-one
(60:40)

A solution of (E)-1-(2-isobutylcyclohex-2-enyl)but-2-en-1-one (202 g, 0.979 mol) in toluene (3 l) was treated with p-toluenesulfonic acid monohydrate (3.7 g, 19.5 mmol), refluxed during 18 h and poured into water. The org. phase was dried ($MgSO_4$) and concentrated. Short-path Vigreux-distillation (0.11 mbar, bath temperature: 140-160° C.) of the crude product (181 g, 68:32 mixture of (E)-1-(2-isobutylcyclohex-1-enyl)but-2-en-1-one/(E)-1-(2-isobutylcyclohex-2-enyl)but-2-en-1-one) gave a mixture of butenones (181 g, 90%, boiling range 90-110° C.) that was redistilled (0.08 mbar, bath temperature: 150° C.) using a Sulzer-column affording a 60:40 mixture of (E)-1-(2-isobutylcyclohex-1-enyl)but-2-en-1-one/(E)-1-(2-isobutylcyclohex-2-enyl)but-2-en-1-one (145.6 g, 72%).

Example 3

(E)-1-(2-isobutylcyclohex-1-enyl)but-2-en-1-one/
(E)-1-(2-isobutylcyclohex-2-enyl)but-2-en-1-one
(91:9)

A solution of (E)-1-(2-isobutylcyclohex-2-enyl)but-2-en-1-one (2.7 g, 13.1 mmol) in toluene (28 ml) was treated with p-toluenesulfonic acid monohydrate (70 mg, 0.37 mmol), refluxed during 18 h and poured into water. The water phase was extracted three times with diethyl ether and the combined org. phases were washed with a saturated aqueous solution of sodium bicarbonate, dried ($MgSO_4$) and concentrated. FC (400 g $SiO_2$, hexane/diethylether 90:0.5) of the crude product (3.2 g, 64:36 mixture of (E)-1-(2-isobutylcyclohex-1-enyl) but-2-en-1-one (B)/(E)-1-(2-isobutylcyclohex-2-enyl)but-2-en-1-one (A)) gave a first fraction (0.31 g, 11%, 10:90 B/A), a second fraction (0.52 g, 19%, 71:29 B/A), and a third fraction (0.39 g, 14%, 91:9 B/A).

Example 4

(4' Z)-2,2-Dimethyl-5-(2'-methyloct-4'-enyl)-2,5-dihydrofuran

Under an atmosphere of nitrogen, a solution of 46.3 g (413 mmol) of potassium tert-butoxide in 250 mL of dry THF was a added between −15° C. and −10° C. to a stirred mixture of 150 g (376 mmol) butyl triphenylphosphonium bromide in 500 mL of dry THF. After complete addition, stirring was continued at −10° C. for 30 min, prior to the dropwise addition of 65.3 g (413 mmol) of 3-methyl-5-oxopentyl acetate in 250 mL of dry THF within a period of 30 min. Stirring was continued a further 15 min at −10° C., before the cooling bath was removed and the reaction mixture was allowed to warm to room temp. After 3 h of stirring at room temp., the reaction mixture was poured into 1 L of water, the organic layer separated and aqueous one extracted twice with 1 L of ether each. The combined organic extracts were washed with water and brine, dried with sodium sulphate, and concentrated under reduced pressure. The crude material (191 g) was purified by flash chromatography (1.00 kg of silica gel, pentane/ether, 19:1, $R_f$=0.40) to afford 57.9 g (78%) of (5Z)-3-methylnon-5-enyl acetate as a colourless liquid.

In the next step, 55.0 g (278 mmol) of this (5Z)-3-methylnon-5-enyl acetate was dissolved in 600 mL of a 1:1 mixture of ethanol and water. With vigorous stirring, 55.5 g (1.39 mol) of sodium hydroxide was added, and the reaction mixture was subsequently heated to reflux for 3 h. After the reaction mixture had cooled to room temp., the ethanol was removed in a rotary evaporator under reduced pressure, and the resulting residue diluted with 300 mL of water. The crude product was extracted twice with 500 mL of ether each, and the combined organic extracts were washed twice with 300 mL of brine. After drying with sodium sulphate and removal of the solvent under reduced pressure, the resulting residue (51.2 g) was purified by flash chromatography (1.00 kg of silica gel, pentane/ether, 9:1, $R_f$=0.11) to provide 39.9 g (92%) of (5Z)-3-methylnon-5-en-1-ol as a colourless liquid.

A solution of 10.4 g (95.6 mmol) of ethyl bromide in 40 mL of dry tetrahydrofuran was added dropwise over a period of 30 min to a vigorously stirred suspension of 2.32 g (95.6 mmol) of magnesium turnings in 15 mL of dry tetrahydrofuran, with the reaction being initiated by occasional heating with a heat gun. After stirring the reaction mixture for 90 min under reflux, it was allowed to cool down to room temp., and a solution of 3.54 g (42.2 mmol) of 2-methylbut-3-yn-2-ol in 40 mL of dry tetrahydrofuran was added dropwise with stirring. The reaction mixture was then again refluxed for 3 h, the heating bath removed and a solution of 6.50 g (42.2 mmol) of (5Z)-3-methylnon-5-en-1-ol in 40 mL of dry tetrahydrofuran added at room temp. with stirring over a period of 30 min. The reaction mixture was refluxed with stirring overnight, allowed to cool to room temp., and quenched by pouring into 100 mL of an aqueous satd. $NH_4Cl$ solution. The organic layer was separated, and the aqueous one extracted three times with 500 mL of ether each. The combined organic extracts were dried with sodium sulphate, and concentrated to dryness in a rotary evaporator. The resulting residue (10.8 g) was purified by flash chromatography (200 g of silica gel, pentane/ether, 1:1, $R_f$=0.22) to furnish 7.76 g (77%) of (9Z)-2,7-dimethyltridec-9-en-3-yne-2,5-diol as a colourless oil.

At room temp., 520 mg (0.488 mmol) of 10% palladium on barium sulphate and 190 mg (1.47 mmol) of quinoline were added to a stirred solution of 7.70 g (32.3 mmol) of this (9Z)-2,7-dimethyltridec-9-en-3-yne-2,5-diol in 170 mL of ethanol. The flask was evacuated and flushed with nitrogen three times, and three times evacuated and flushed with hydrogen. The resulting reaction mixture was then stirred for 1.5 h under an atmosphere of hydrogen at ambient pressure and temperature, prior to evacuation and ventilation with nitrogen. The reaction flask was opened to air, and the catalyst filtered off by suction over a pad of Celite. After removal of the solvent in a rotary evaporator under reduced pressure, the resulting crude product (8.07 g) was purified by flash chromatography (100 g of silica gel, pentane/ether, 1:1, $R_f$=0.28) to afford 4.28 g (55%) of (3Z,9Z)-2,7-dimethyltrideca-3,9-diene-2,5-diol as a colorless oil.

In a Kugelrohr distillation apparatus 4.20 g (17.5 mmol) of (3Z,9Z)-2,7-dimethyltrideca-3,9-diene-2,5-diol and 300 mg (2.21 mmol) of $KHSO_4$ were heated to 150° C. at 120 mbar, with trapping the evaporating reaction product in a bulb at −78° C. The temperature was gradually increased to 180° C. until no further material condensed in the cold trap. The resulting distillate (2.27 g) was purified by flash chromatography (200 g of silica-gel, pentane/ether, 99:1, $R_f$=0.66 for pentane/ether, 19:1) to furnish 2.14 g (55%) of the title compound. Further purification by Kugelrohr distillation provided at 70-80° C./0.05 mbar 1.14 g (29%) of (4'Z)-2,2-dimethyl-5-(2'-methyloct-4'-enyl)-2,5-dihydrofuran as a colourless liquid diastereomeric mixture.

Example 5

(2E)-1-(rel-(1R,2S,6S)-6-Ethyl-2-methylcyclohex-3-enyl)but-2-en-1-one

A) At −15° C., a solution of $BF_3.OEt_2$ (54 g, 0.38 mol) in dichloromethane (680 ml) was treated within 10 min. with 3-hexen-2-one (220.1 g, 89% pure, 2 mol). 1,3-Pentadiene (490 g, 7.2 mol, precooled at 0° C.) was then added and the resulting solution stirred 30 min. at 0° C. then 1 h at 20° C. before being cooled at 0° C. and treated with a solution of 20% aqueous $K_2CO_3$ (250 ml). The resulting mixture was stirred 40 min. and concentrated (43° C. till 300 mbar). The aqueous phase was washed with hexane (500 ml) and the combined organic phases with 20% aqueous $K_2CO_3$ (100 ml), three times with saturated aqueous NaCl solution, dried ($MgSO_4$) and concentrated. Sulzer-distillation (0.4-0.1 mbar) of the crude product (400 g) gave 1-(rel-(1R,2S,6S)-6-ethyl-2-methylcyclohex-3-enyl)ethan-1-one (326 g, 98% yield).

B) At −78° C., a solution of diisopropylamine (6.6 g, 34 mmol) in tetrahydrofuran (23 ml) was treated with n-butyl lithium (21 ml, 1.6M in hexane, 34 mmol). The resulting solution was warmed to 0° C., cooled to −78° C., and treated with a solution of 1-(rel-(1R,2S,6S)-6-ethyl-2-methylcyclohex-3-enyl)ethan-1-one (4.5 g, 27 mmol) in tetrahydrofuran (23 ml). The resulting solution was stirred 20 min. at −20° C., cooled to −78° C. and treated with a solution of acetaldehyde (1.8 g, 41 mmol) in tetrahydrofuran (23 ml). After 1 h stirring, aqueous 1N HCl (50 ml) was added and the reaction mixture warmed to 20° C. The aq. phase was extracted with diethyl ether and the combined org. phases dried ($MgSO_4$), and concentrated. A solution of the residue (4.9 g) in toluene (4.9 ml) was treated with para-toluene sulfonic acid monohydrate (20 mg) and refluxed overnight. The reaction mixture was cooled, treated with a saturated aqueous solution of $NaHCO_3$ and the aqueous phase was extracted with diethyl ether. The combined organic phases were dried ($MgSO_4$) and concentrated. FC (550 g $SiO_2$, hexane/diethyl ether 9:1) of the crude product gave (2E)-1-(rel-(1R,2S,6S)-6-ethyl-2-methylcyclohex-3-enyl)but-2-en-1-one (2.9 g, 56%).

Example 6

Preformed Amine Reaction Product

The following ingredients are weighted off in a glass vial:

50% of the perfume material

50% of Lupasol WF (CAS#09002-98-6) from BASF, is put at 60° C. in warm water bath for 1 hour before use. Mixing of the two ingredients was done by using the Ultra-Turrax T25 Basic equipment (from IKA) during 5 minutes. When the mixing is finished the sample is put in a warm water bath at 60° C. for ±12 hours. A homogenous, viscous material is obtained. In the same way as described above different ratios between the components can be used:

| | Weight % | | | | |
|---|---|---|---|---|---|
| Perfume Material | 40 | 50 | 60 | 70 | 80 |
| Lupasol WF | 60 | 50 | 40 | 30 | 20 |

Example 7

Non-limiting examples of product formulations containing perfume and amines summarized in the following table.

| | EXAMPLES | | | | | | | | | |
|---|---|---|---|---|---|---|---|---|---|---|
| (% wt) | XI | XII | XIII | XIV | XV | XVI | XVII | XVIII | XIX | XX |
| FSA[a] | 14 | 16.47 | 14 | 12 | 12 | 16.47 | — | — | 5 | 5 |
| FSA[b] | | | | | — | | 3.00 | — | — | — |
| FSA[c] | | | | | — | | — | 6.5 | — | — |
| Ethanol | 2.18 | 2.57 | 2.18 | 1.95 | 1.95 | 2.57 | — | — | 0.81 | 0.81 |
| Isopropyl Alcohol | — | — | — | — | — | — | 0.33 | 1.22 | — | — |
| Starch[d] | 1.25 | 1.47 | 2.00 | 1.25 | — | 2.30 | 0.5 | 0.70 | 0.71 | 0.42 |
| Amine* | 0.6 | 0.75 | 0.6 | 0.75 | 0.37 | 0.60 | 0.37 | 0.6 | 0.37 | 0.37 |
| Perfume X[e] | 0.40 | 0.13 | 0.065 | 0.25 | 0.03 | 0.030 | 0.030 | 0.065 | 0.03 | 0.03 |
| Phase Stabilizing Polymer[f] | 0.21 | 0.25 | 0.21 | 0.21 | 0.14 | — | — | 0.14 | — | — |
| Suds Suppressor[g] | — | — | — | — | — | — | — | 0.1 | — | — |
| Calcium Chloride | 0.15 | 0.176 | 0.15 | 0.15 | 0.30 | 0.176 | — | 0.1-0.15 | — | — |
| DTPA[h] | 0.017 | 0.017 | 0.017 | 0.017 | 0.007 | 0.007 | 0.20 | — | 0.002 | 0.002 |
| Preservative (ppm)[i,j] | 5 | 5 | 5 | 5 | 5 | 5 | — | 250[j] | 5 | 5 |
| Antifoam[k] | 0.015 | 0.018 | 0.015 | 0.015 | 0.015 | 0.015 | — | — | 0.015 | 0.015 |
| Dye (ppm) | 40 | 40 | 40 | 40 | 40 | 40 | 11 | 30-300 | 30 | 30 |
| Ammonium Chloride | 0.100 | 0.118 | 0.100 | 0.100 | 0.115 | 0.115 | — | — | — | — |
| HCl | 0.012 | 0.014 | 0.012 | 0.012 | 0.028 | 0.028 | 0.016 | 0.025 | 0.011 | 0.011 |
| Structurant[l] | 0.01 | 0.01 | 0.01 | 0.01 | 0.01 | 0.01 | 0.01 | 0.01 | 0.01 | 0.01 |
| Neat Perfume | 0.8 | 0.7 | 0.9 | 0.5 | 1.2 | 0.5 | 1.1 | 0.6 | 1.0 | 0.9 |
| Deionized Water | † | † | † | † | † | † | † | † | † | † |

[a]N,N-di(tallowoyloxyethyl)-N,N-dimethylammonium chloride.

[b]Methyl bis(tallow amidoethyl)2-hydroxyethyl ammonium methyl sulfate.

[c]Reaction product of Fatty acid with Methyldiethanolamine in a molar ratio 1.5:1, quaternized with Methylchloride, resulting in a 1:1 molar mixture of N,N-bis(stearoyl-oxy-ethyl) N,N-dimethyl ammonium chloride and N-(stearoyl-oxy-ethyl) N,-hydroxyethyl N,N dimethyl ammonium chloride.

[d]Cationic high amylose maize starch available from National Starch under the trade name CATO ®.

[e]Suitable combinations of the fragrance molecules provided in Examples 1 through 5.

[f]Copolymer of ethylene oxide and terephthalate having the formula described in U.S. Pat. No. 5,574,179 at col.15, lines 1-5, wherein each X is methyl, each n is 40, u is 4, each R1 is essentially 1,4-phenylene moieties, each R2 is essentially ethylene, 1,2-propylene moieties, or mixtures thereof.

[g]SE39 from Wacker

[h]Diethylenetriaminepentaacetic acid.

[i]KATHON ® CG available from Rohm and Haas Co. "PPM" is "parts per million."

[j]Gluteraldehyde

[k]Silicone antifoam agent available from Dow Corning Corp. under the trade name DC2310.

[l]Hydrophobically-modified ethoxylated urethane available from Rohm and Haas under the tradename Aculan 44.

*One or more materials comprising an amine moiety as disclosed in the present specification.

† balance

Example 8

Dry Laundry Formulations

| Component | % w/w granular laundry detergent composition | | | | | | |
|---|---|---|---|---|---|---|---|
| | A | B | C | D | E | F | G |
| Brightener | 0.1 | 0.1 | 0.1 | 0.2 | 0.1 | 0.2 | 0.1 |
| Soap | 0.6 | 0.6 | 0.6 | 0.6 | 0.6 | 0.6 | 0.6 |
| Ethylenediamine disuccinic acid | 0.1 | 0.1 | 0.1 | 0.1 | 0.1 | 0.1 | 0.1 |
| Acrylate/maleate copolymer | 1.5 | 1.5 | 1.5 | 1.5 | 1.5 | 1.5 | 1.5 |
| Hydroxyethane di(methylene phosphonic acid) | 0.4 | 0.4 | 0.4 | 0.4 | 0.4 | 0.4 | 0.4 |
| Mono-$C_{12-14}$ alkyl, di-methyl, mono-hydroyethyl quaternary ammonium chloride | 0.5 | 0.5 | 0.5 | 0.5 | 0.5 | 0.5 | 0.5 |
| Linear alkyl benzene | 0.1 | 0.1 | 0.2 | 0.1 | 0.1 | 0.2 | 0.1 |
| Linear alkyl benzene sulphonate | 10.3 | 10.1 | 19.9 | 14.7 | 10.3 | 17 | 10.5 |
| Magnesium sulphate | 0.4 | 0.4 | 0.4 | 0.4 | 0.4 | 0.4 | 0.4 |
| Sodium carbonate | 19.5 | 19.2 | 10.1 | 18.5 | 29.9 | 10.1 | 16.8 |
| Sodium sulphate | 29.6 | 29.8 | 38.8 | 15.1 | 24.4 | 19.7 | 19.1 |
| Sodium Chloride | 0.1 | 0.1 | 0.1 | 0.1 | 0.1 | 0.1 | 0.1 |
| Zeolite | 9.6 | 9.4 | 8.1 | 18 | 10 | 13.2 | 17.3 |
| Photobleach particle | 0.1 | 0.1 | 0.2 | 0.1 | 0.2 | 0.1 | 0.2 |
| Blue and red carbonate speckles | 1.8 | 1.8 | 1.8 | 1.8 | 1.8 | 1.8 | 1.8 |
| Ethoxylated Alcohol AE7 | 1 | 1 | 1 | 1 | 1 | 1 | 1 |
| Tetraacetyl ethylene diamine agglomerate (92 wt % active) | 0.9 | 0.9 | 0.9 | 0.9 | 0.9 | 0.9 | 0.9 |
| Citric acid | 1.4 | 1.4 | 1.4 | 1.4 | 1.4 | 1.4 | 1.4 |
| PDMS/clay agglomerates (9.5% wt % active PDMS) | 10.5 | 10.3 | 5 | 15 | 5.1 | 7.3 | 10.2 |
| Polyethylene oxide | 0.2 | 0.2 | 0.2 | 0.2 | 0.2 | 0.2 | 0.2 |
| Enzymes e.g. Protease (84 mg/g active), Amylase (22 mg/g active) | 0.2 | 0.3 | 0.2 | 0.1 | 0.2 | 0.1 | 0.2 |
| Suds suppressor agglomerate (12.4 wt % active) | 0.2 | 0.2 | 0.2 | 0.2 | 0.2 | 0.2 | 0.2 |
| Sodium percarbonate (having from 12% to 15% active AvOx) | 7.2 | 7.1 | 4.9 | 5.4 | 6.9 | 19.3 | 13.1 |
| Perfume oil | 0.5 | 0.5 | 0.5 | 0.5 | 0.5 | 0.5 | 0.5 |
| Solid perfume particles | 0.4 | 0 | 0.4 | 0.4 | 0.4 | 0.4 | 0.6 |
| Amine* | 0.1 | 0.5 | 0.0 | 0.01 | 0.02 | 0.00 | 0.07 |
| Perfume reaction product as disclosed in Example 6 | 0.05 | 0.0 | 0.1 | 0.0 | 0.2 | 0.4 | 0.0 |
| Perfumes from Examples 1 to 5 | 0.3 | 0.4 | 0.01 | 0.02 | 0.04 | 0.1 | 0.1 |
| Water | 1.4 | 1.4 | 1.4 | 1.4 | 1.4 | 1.4 | 1.4 |
| Misc | 0.1 | 0.1 | 0.1 | 0.1 | 0.1 | 0.1 | 0.1 |
| Total Parts | 100 | 100 | 100 | 100 | 100 | 100 | 100 |

*One or more materials comprising an amine moiety as disclosed in the present specification.

Example 9

Liquid Laundry Formulations (HDLs)

| Ingredient | HDL 1 | HDL 2 | HDL3 | HDL4 | HDL 5 | HDL 6 |
|---|---|---|---|---|---|---|
| Alkyl Ether Sulphate | 0.00 | 0.50 | 12.0 | 12.0 | 6.0 | 7.0 |
| Dodecyl Benzene Sulphonic Acid | 8.0 | 8.0 | 1.0 | 1.0 | 2.0 | 3.0 |
| Ethoxylated Alcohol | 8.0 | 6.0 | 5.0 | 7.0 | 5.0 | 3.0 |
| Citric Acid | 5.0 | 3.0 | 3.0 | 5.0 | 2.0 | 3.0 |
| Fatty Acid | 3.0 | 5.0 | 5.0 | 3.0 | 6.0 | 5.0 |
| Ethoxysulfated hexamethylene diamine quaternized | 1.9 | 1.2 | 1.5 | 2.0 | 1.0 | 1.0 |
| Diethylene triamine penta methylene phosphonic acid | 0.3 | 0.2 | 0.2 | 0.3 | 0.1 | 0.2 |
| Enzymes | 1.20 | 0.80 | 0 | 1.2 | 0 | 0.8 |
| Brightener (disulphonated diamino stilbene based FWA) | 0.14 | 0.09 | 0 | 0.14 | 0.01 | 0.09 |

-continued

| Ingredient | HDL 1 | HDL 2 | HDL3 | HDL4 | HDL 5 | HDL 6 |
|---|---|---|---|---|---|---|
| Cationic hydroxyethyl cellulose | 0 | 0 | 0.10 | 0 | 0.200 | 0.30 |
| Poly(acrylamide-co-diallyldimethylammonium chloride) | 0 | 0 | 0 | 0.50 | 0.10 | 0 |
| Hydrogenated Castor Oil Structurant | 0.50 | 0.44 | 0.2 | 0.2 | 0.3 | 0.3 |
| Boric acid | 2.4 | 1.5 | 1.0 | 2.4 | 1.0 | 1.5 |
| Ethanol | 0.50 | 1.0 | 2.0 | 2.0 | 1.0 | 1.0 |
| 1,2 propanediol | 2.0 | 3.0 | 1.0 | 1.0 | 0.01 | 0.01 |
| Glutaraldehyde | 0 | 0 | 19 ppm | 0 | 13 ppm | 0 |
| Diethyleneglycol (DEG) | 1.6 | 0 | 0 | 0 | 0 | 0 |
| 2,3-Methyl-1,3-propanediol (M pdiol) | 1.0 | 1.0 | 0 | 0 | 0 | 0 |
| Mono Ethanol Amine | 1.0 | 0.5 | 0 | 0 | 0 | 0 |
| NaOH Sufficient To Provide Formulation pH of: | pH 8 | pH 8 | pH 8 | pH 8 | pH 8 | pH 8 |
| Sodium Cumene Sulphonate (NaCS) | 2.00 | 0 | 0 | 0 | 0 | 0 |
| Silicone (PDMS) emulsion | 0.003 | 0.003 | 0.003 | 0.003 | 0.003 | 0.003 |
| Perfume | 0.7 | 0.5 | 0.8 | 0.8 | 0.6 | 0.6 |
| Amine* | 0.01 | 0.10 | 0.0 | 0.10 | 0.20 | 0.05 |
| Perfume From Examples 1-5 | 0.02 | 0.15 | 0.0 | 0.2 | 0.3 | 0.1 |
| Perfume reaction product as disclosed in Example 6 | 0.2 | 0.02 | 0.4 | 0.0 | 0.0 | 0.0 |
| Water | Balance | Balance | Balance | Balance | Balance | Balance |

*One or more materials comprising an amine moiety as disclosed in the present specification.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A consumer product comprising:

a.) a perfume reaction product comprising:

i. (2E,5E/Z)-5,6,7-trimethylocta-2,5-dien-4-one; and ii. a polyethyleneimine; and b.) an adjunct ingredient;

wherein the perfume reaction product is formed before the perfume reaction product is combined with the adjunct ingredient.

* * * * *